US010953299B1

(12) United States Patent
Bennett

(10) Patent No.: US 10,953,299 B1
(45) Date of Patent: Mar. 23, 2021

(54) WAVE TAINER DISPLACEMENT WAVE GENERATOR

(71) Applicant: Walter Judson Bennett, Mechanicsville, VA (US)

(72) Inventor: Walter Judson Bennett, Mechanicsville, VA (US)

( * ) Notice: Subject to any disclaimer, the term of this patent is extended or adjusted under 35 U.S.C. 154(b) by 0 days.

(21) Appl. No.: 16/873,760

(22) Filed: Jun. 29, 2020

(51) Int. Cl.

| | |
|---|---|
| ***A63B 69/00*** | (2006.01) |
| ***A63B 69/12*** | (2006.01) |
| ***F04D 35/00*** | (2006.01) |
| ***A63G 31/00*** | (2006.01) |

(52) U.S. Cl.
CPC ..... *A63B 69/0093* (2013.01); *A63G 31/007* (2013.01); *F04D 35/00* (2013.01)

(58) Field of Classification Search
CPC .... A63B 69/0093; F04D 35/00; A63G 31/007
USPC ..... 405/79–127
See application file for complete search history.

(56) References Cited

U.S. PATENT DOCUMENTS

| | | | | |
|---|---|---|---|---|
| 2,002,045 | A | 5/1935 | Price | |
| 3,350,724 | A | 11/1967 | Leigh | |
| 3,789,612 | A | 2/1974 | Richard | |
| 3,973,405 | A | 8/1976 | Duport | |
| 3,981,612 | A * | 9/1976 | Bunger | F04D 35/00 416/66 |
| 4,229,969 | A | 10/1980 | Hark | |
| 4,276,664 | A | 7/1981 | Baker | |
| 4,806,048 | A | 2/1989 | Ito | |
| 4,810,129 | A | 3/1989 | Guevel | |
| 5,205,670 | A * | 4/1993 | Hill | E04H 4/0006 472/88 |
| 6,336,771 | B1 * | 1/2002 | Hill | A63G 31/007 405/79 |
| 6,729,799 | B1 | 5/2004 | Raike | |
| 9,777,494 | B2 | 10/2017 | Lochtefeld | |
| 9,920,544 | B1 | 3/2018 | Bennett | |
| 9,926,712 | B2 | 3/2018 | Oshibe | |
| 10,501,951 | B2 | 12/2019 | Trevis | |
| 10,519,679 | B1 | 12/2019 | Bennett | |
| 2014/0189948 | A1 | 7/2014 | Lochtefeld | |
| 2017/0204627 | A1 | 7/2017 | Trevis | |

FOREIGN PATENT DOCUMENTS

| | | |
|---|---|---|
| WO | WO-2015188219 A1 | 12/2015 |
| WO | WO-2016129107 A1 | 8/2016 |

* cited by examiner

*Primary Examiner* — Edwin J Toledo-Duran

(57) ABSTRACT

The present invention is a shipping container water displacement activated wave generating device for use in a body of water. The wave generating device preferably has displacement forming characteristics that help to create laminar waves which then transverse a slope or artificial surfing reef to create waves which surfing maneuvers can be performed. The water displacement device is a wave container, which is oscillated up and down by mechanical means and the container displaces water to form a swell toward the slope or reefs and creates a wave for surfing.

6 Claims, 6 Drawing Sheets

WAVE TAINER DISPLACEMENT WAVE GENERATOR

BACKGROUND

Unlike all other existing and planned wave pools, the WaveTainer wave generator has no dangerous moving underwater profiles, no hydrofoils or expensive water jet systems, no modular timed sequenced wave systems and no piston wall modules moving backward and forward. It's just a simple yet highly energy-efficient displacement wave generator that exquisitely matches real-world ocean waves. It can produce single waves on demand, every eight seconds.

SUMMARY OF THE INVENTION

The present invention represents a substantial improvement over prior wave generating device's in that the present invention is displacement activated. The current invention is a retro fitted steel shipping container. Trade Mark application the "WaveTainer." The WaveTainer has several advantages over other wave making technologies. Such as the shipping containers can easily be shipped anywhere in the world and then trucked to the surf lake job site for installation. Once the shipping containers arrive on site, they can be easily lifted up by a small crane or excavator and placed into their permeant wave making position. The WaveTainer is a significant advantage of prior wave generating inventions, because it is energy efficient operated by an AC motor, gear box, fly wheel and a belt drive, it has a high frequency capability of producing a wave every eight seconds and is very simply to operate. The WaveTainer can also be operated by hydraulics, such as a hydraulic cylinder or hydraulic motor and belt drive. However, the cost of hydraulics compared to a motor drive system is not cost effective. This is a huge improvement over current plunger wave technologies to make surfing waves because there is a high cost to make each individual plunger. By using a twenty- or forty-foot shipping container this creates huge savings in build out costs. Most plunger wave makers are built in 8-10 feet wide steel modular plunger sections. With using a 20- or 40-foot shipping container, your costs are four times less expensive for 40 feet of wave generation.

The WaveTainer can be made in different widths and heights. The common lengths are, 20 feet and 40 feet shipping containers. Although can be made in any height or length. The height of the shipping containers depends on the height of wave that is being generated. The shipping containers are reinforced and retrofitted with steel stiffeners to ensure as they are oscillating upward and downward that they can handle the forces in displacing the water into the body of water.

There are two steel I Beams, placed in cement footings on both sides of the, 20 foot or 40-foot wave making shipping container. There is a perpendicular I beam at the top of both parallel I beams to hold them together. The channel beams bolt to the I beams running all the way across the wave making container are two channel beams. There is a steel mounting structure that is mounted above the shipping containers. The AC motor, gear box and fly wheel are all bolted to the steel mounting beam. The AC motor turns the gear box connected by a belt and the gear box is connected to the fly wheel via a belt or chain. The rod link is connected to the fly wheel and to the top of the shipping container. As the fly wheel turns the rod link actuates the WaveTainers to oscillate up and down and push a swell into the body of water. The wave making containers can also be powered up and down by using a dual open ended hydraulic or noematic cylinder. Water ballast is added to the shipping containers to reduce upward buoyancy forces. Other ballast can also be added to the shipping containers such as sand, dirt, cement or crushed stone. The wave making containers are made with I beams as the internal steel structure frame. Then there is UHMWPE or HDPE panels that are bolted to the outside frame of the Ibeam structure.

DETAILED DESCRIPTION OF THE DRAWINGS

Figure 1:
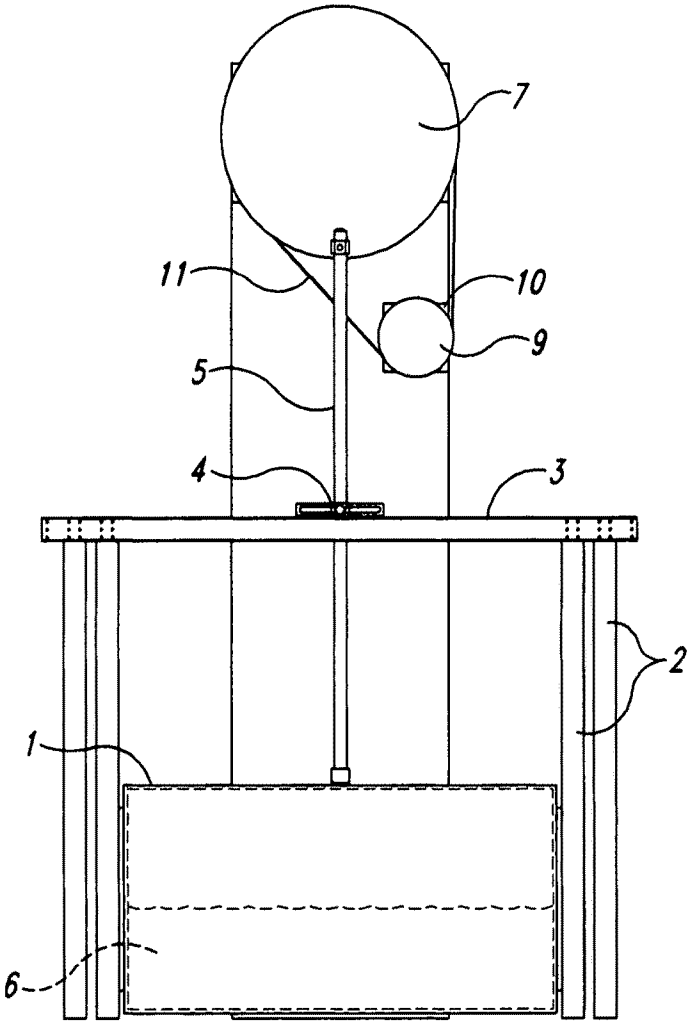
FIG. 1 Front view of the wave making container in the down position.

FIG. 1 is a front view of the Wave Making Container 1 in the down position. The wave making container is filled with ballast 6. The ballast 6 off sets the upward buoyancy forces. There are two steel I beams 2 on each side of the wave making container 1. There are two channel beams 3 that run the entire length of the wave making container 1. The two channel beams 3 bolt to the two I beams 2. The rod link 5 is attached 4 to the two channel beams 3.

Figure 2:
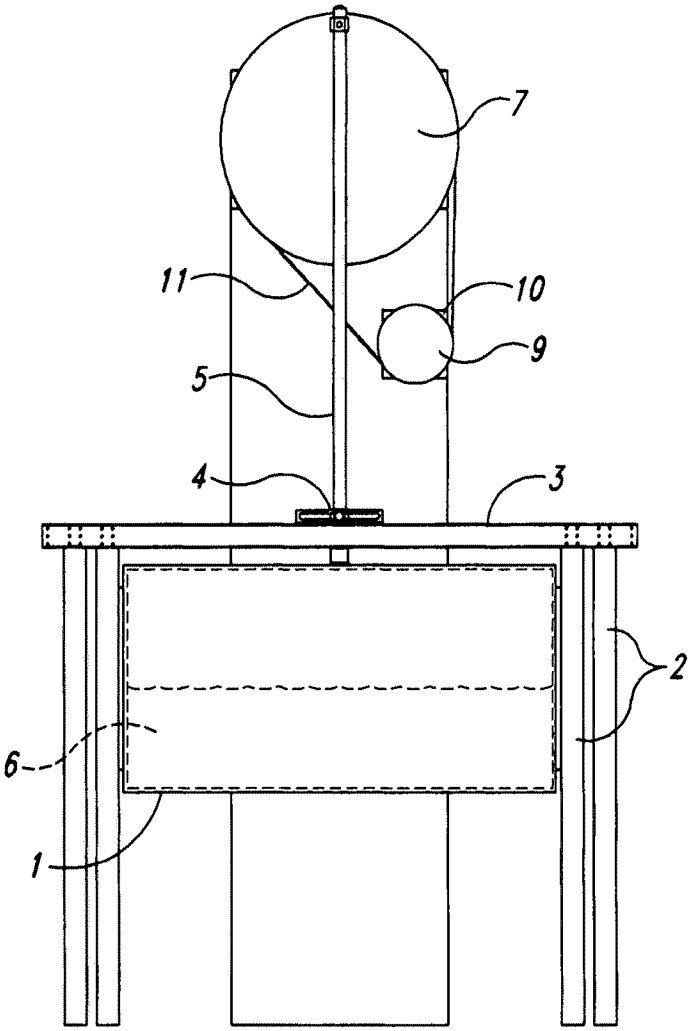
FIG. 2 Front view of the wave making container in the up position.

FIG. 2. is a front view of the Wave Making Container 1 in the up position. The wave making container is filled with ballast 6. The ballast off sets the upward buoyancy forces. There are two steel I beams 2 on each side of the wave making container 1. There are two channel beams 3 that run the entire length of the wave making container 1. The two channel beams 3 bolt to the two I beams 2. The rod link 5 is attached 4 to the two channel beams 3.

Figure 3:
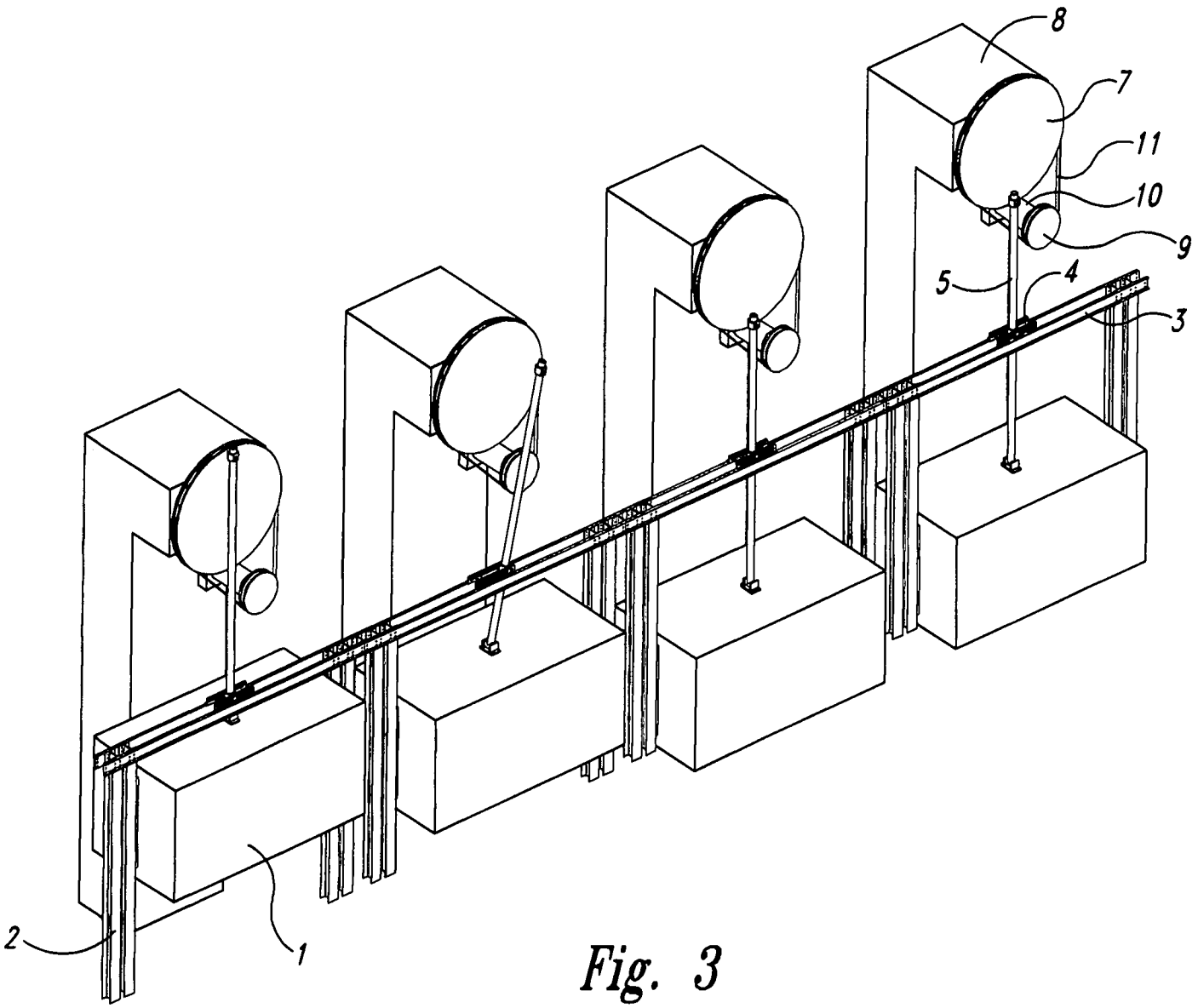
FIG. 3 Top down and front view of the plurality of side by side wave making containers.

FIG. 3 is a top down view of a plurality of wave making containers in a side by side manner oscillating at different times. There is a steel mounting beam 8, that the fly wheel 7 is attached to. There is a rod link 5 that is attached to the fly wheel 7. There is an Alternating Current Motor 10 that has a gear box attached 9. The rod link 5 is attached to the wave making container 1.

Figure 4:
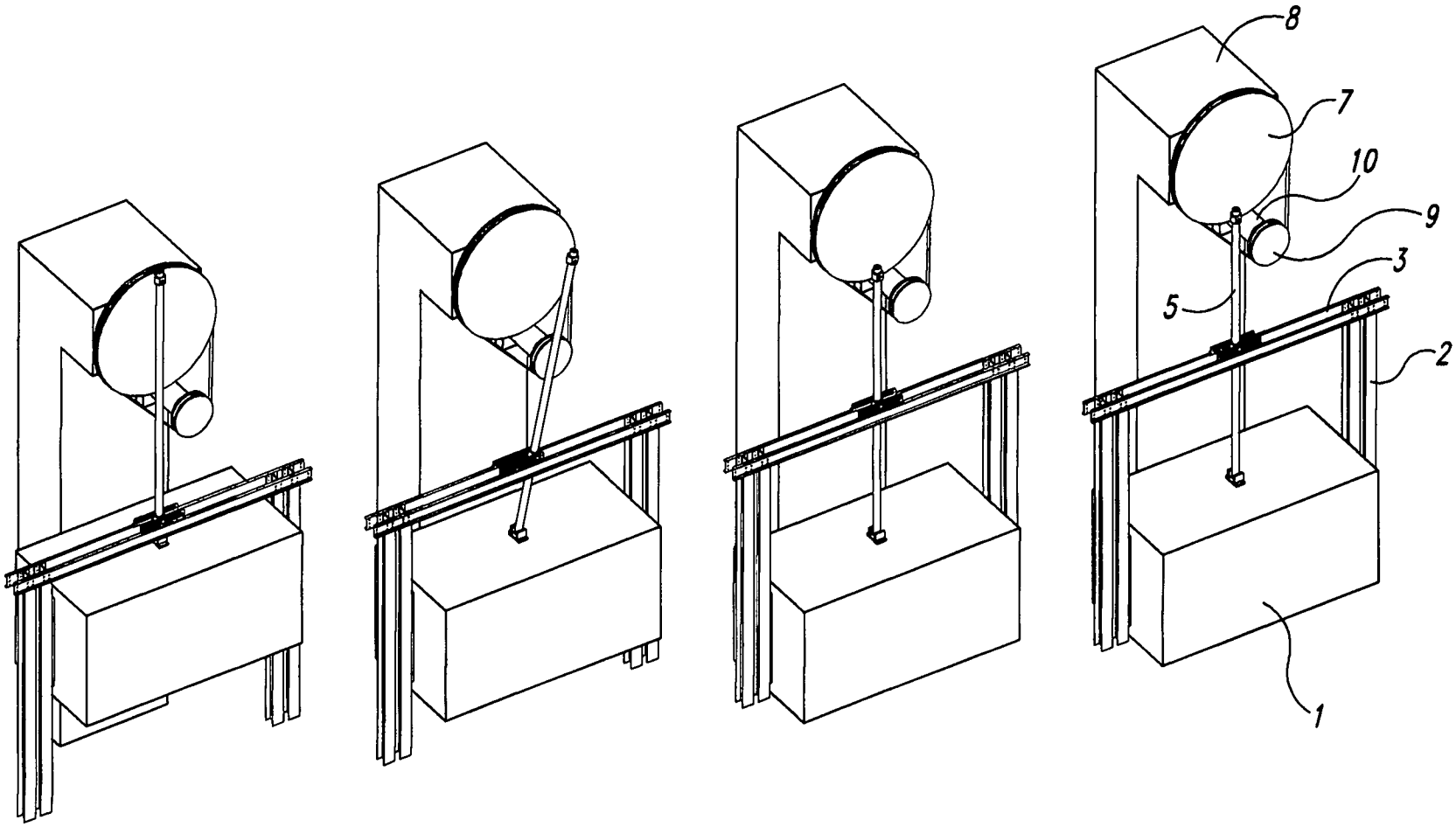
FIG. 4 Top down and front view of the wave making containers at different angles.

FIG. 4 is a top down view of the wave making containers at different angles. There is a steel mounting beam 8, that the fly wheel 7 is attached to. There is a rod link 5 that is attached to the fly wheel 7. There is an alternating current motor 10 that has a gear box attached 9. The rod link 5 is attached to the wave making container 1. The wave making containers 1 are set back from each other and angled.

Figure 5:
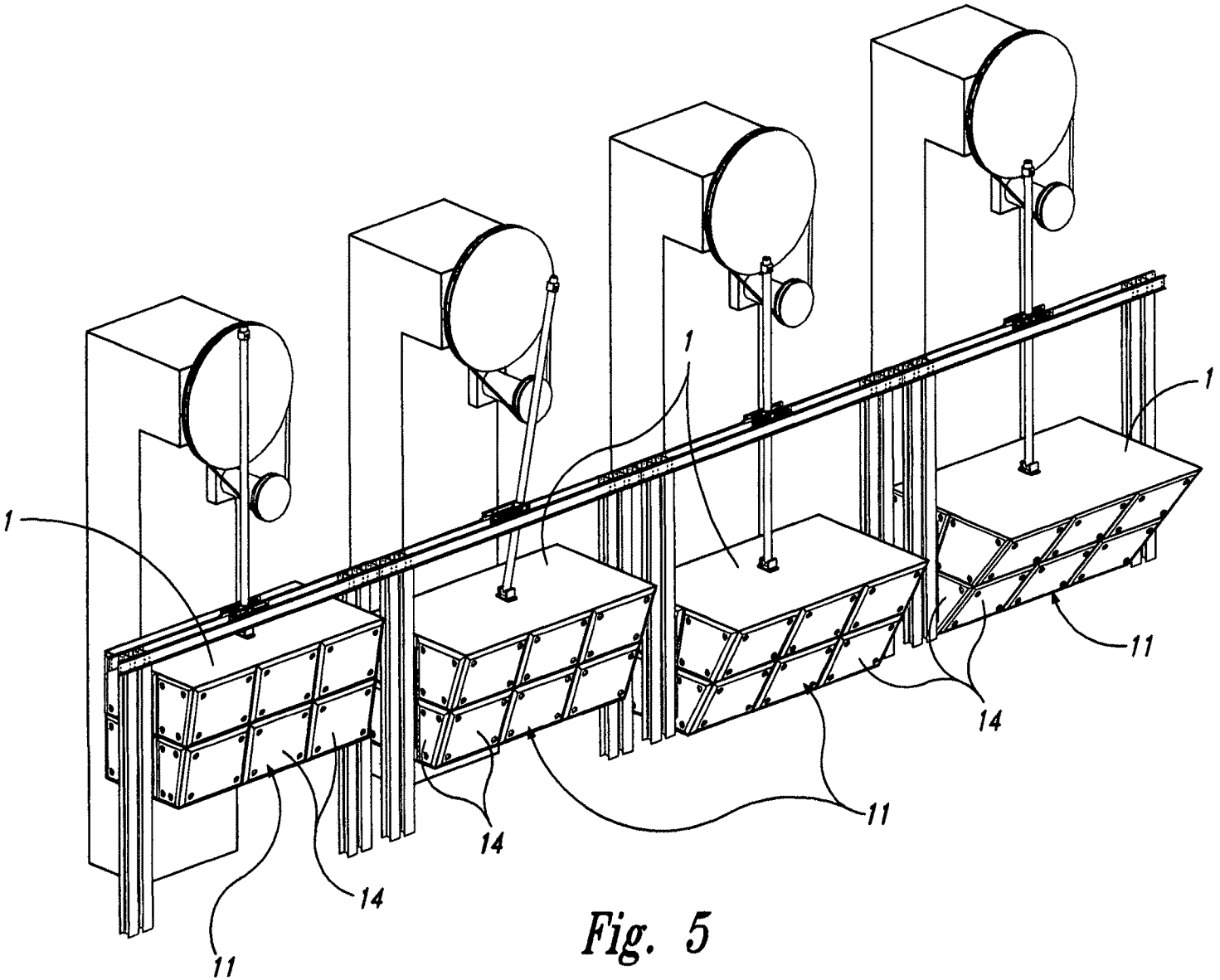
FIG. 5. Top down view of the wave making containers with different water facing front angles to the water.

FIG. 5. Is a top down view of a plurality of individual wave making containers 1 side by side, where the water facing side of the wave making container 1 has a front angle inclination to the water from 0-40 degrees 11 to create a swell into the body of water. The wave making containers 1, are single sided in this illustration. There are UHMWPE panels 14 bolted to the outside of the I beam frame.

Figure 6:
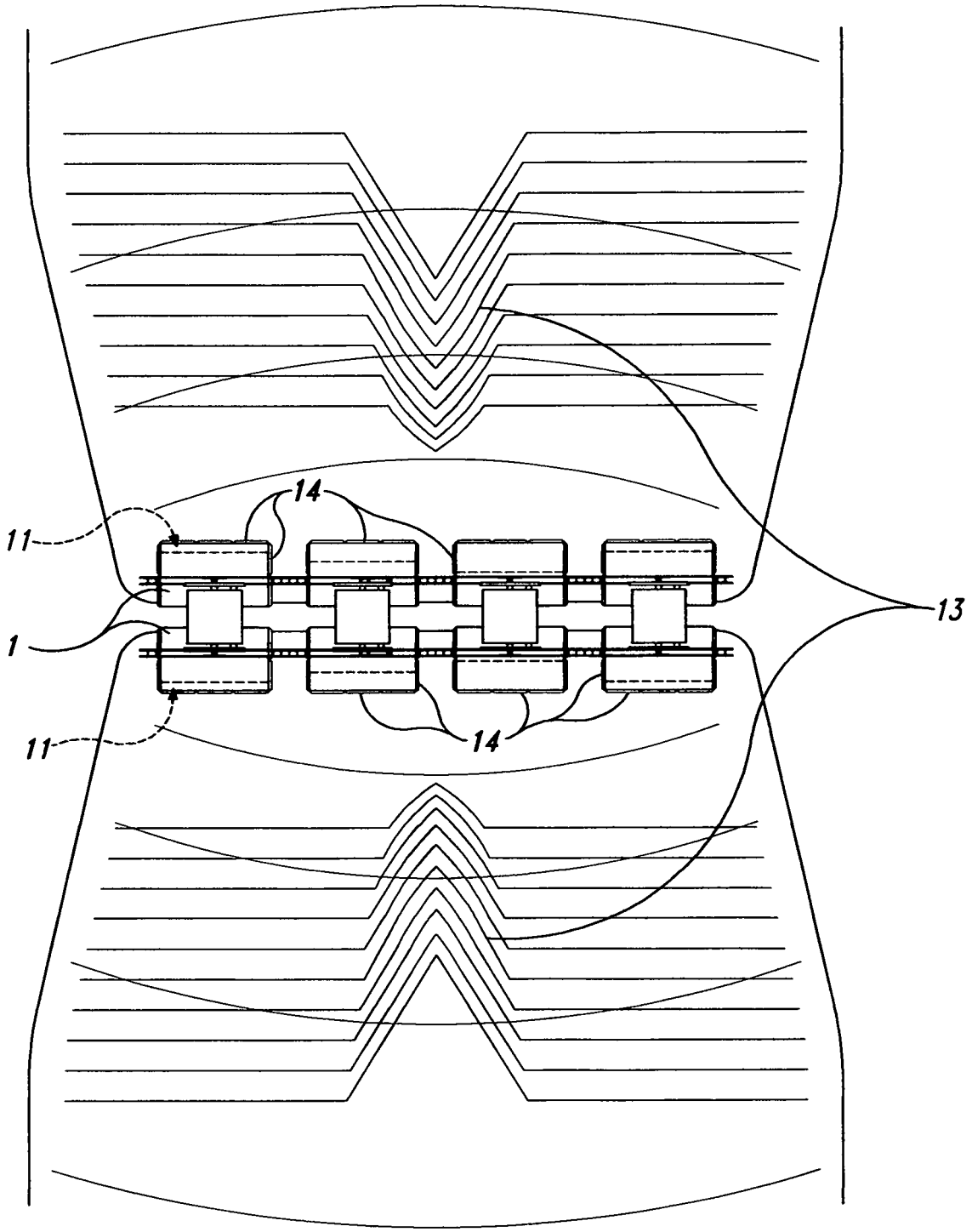
FIG. 6. Top down view of double-sided wave making containers.

FIG. 6. Is a top down view of a plurality of individual wave making containers 1 side by side, where the wave making containers 1 are doubled sided with a water facing front of 0-40 degrees 11 and pushing a swell out to break over artificial reefs on each side 13. There are UHMWPE panels 14 bolted to the I beam frame.

Figure 7:
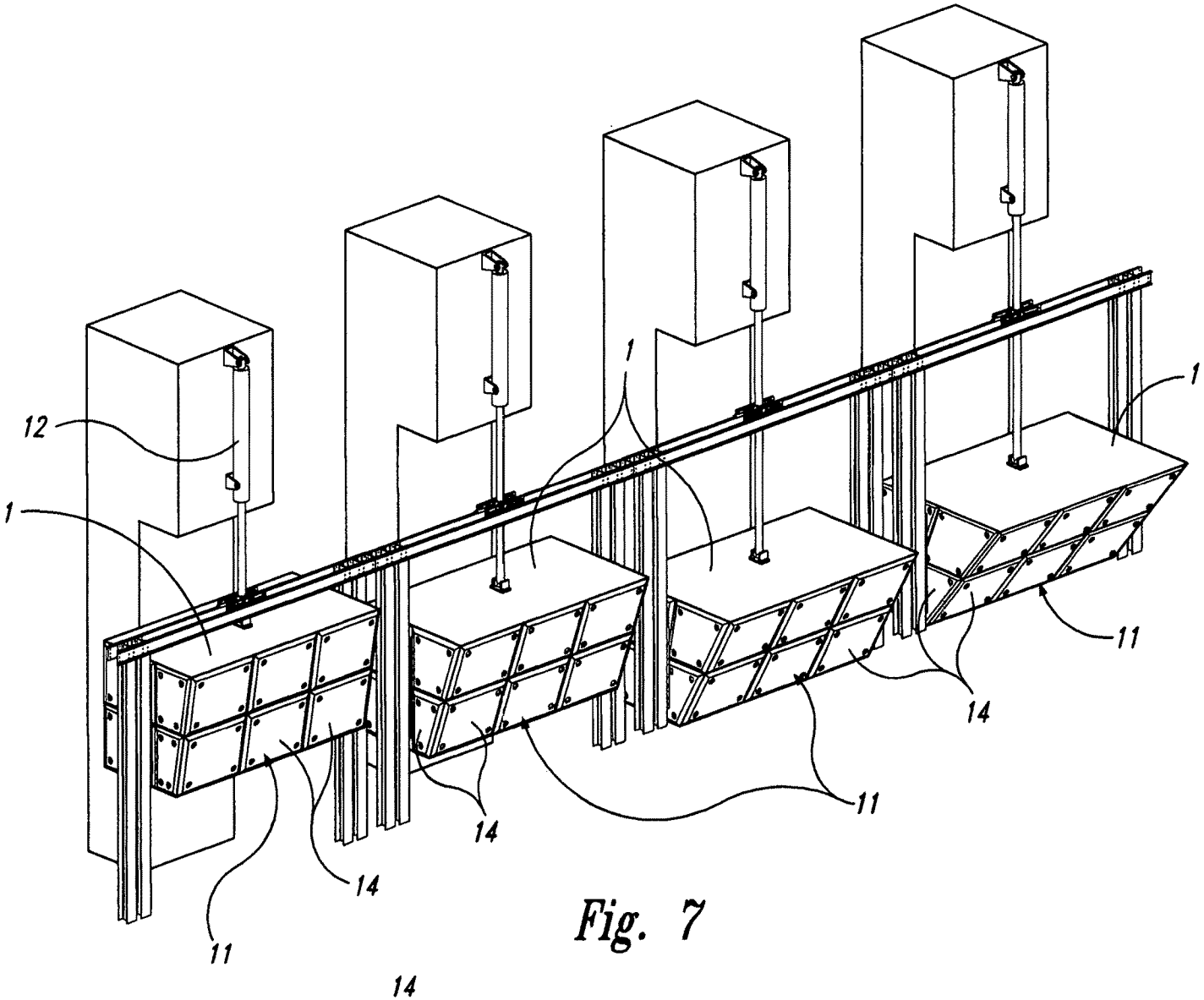
FIG. 7. Top down view of wave making containers being oscillated up and down by a dual open ended hydraulic or pneumatic cylinder.

FIG. 7. Is a top down view of the wave making containers 1 shown in a plurality of individual containers side by side, where the wave making containers 1 can also be oscillated up and down by a dual ended hydraulic or pneumatic cylinder 12. There are UHMWPE panels 14 bolted to the outside of the I beam frame.

The invention claimed is:

1. A wave making container as a wave making apparatus characterized by a reciprocating means arranged to oscillate the wave making container vertically upward and then downward in generating a wave into the body of water and further comprising:

an alternating current motor, and a gear box, and a fly wheel, and a belt, and a rod link, and two I beams on each side of a wave making container, and wherein the two I beams are bolted to two channel steel beams, and wherein the motor, gear box, flywheel are bolted to a steel mounting structure, and wherein the motor is attached to the gear box, the motor turns the gear box, and wherein a belt is attached to the gear box and the fly wheel, and wherein the motor spins, turns the gear box, the belt moves and spins the fly wheel, and wherein the fly wheel turns the rod link and the wave making container oscillates freely up and down to push a swell into the body of water to create waves for surfing, and wherein the wave making container forms part of a plurality of wave making containers side by side where the front facing side of the wave making container has a front angle inclination to the water from 0-40 degrees to create different swells into the body of water, and wherein the wave making container has an angled front face to the water of 0-40 degrees on both sides of the wave making container, and wherein the wave making container is double sided and can push a swell out into the body of water in both directions to break over different artificial reefs.

2. The wave making container as recited in claim 1, the wave making container can be filled with ballast water, concrete, sand, dirt or any weighted substance to add additional weight ballast to a wave making container to displace the water into the body of water.

3. The wave making container as recited in claim 1, wherein the wave making container forms part of a plurality of wave making containers side by side in a reciprocating means arranged to displace water into the body of water to create a swell for surfing waves.

4. The wave making container as recited in claim 1, wherein the wave making container forms part of a plurality of wave making containers side by side in a turned angle from 30-70 degrees to create different swells at different peel angles into the body of water and, wherein a wave making containers are set back from each other and, wherein a wave making containers are oscillating in sequence.

5. The wave making container as recited in claim 1, wherein the wave making container forms part of a plurality of making containers side by side where the water facing side of the wave making container has a front angle inclination to the water from 0-40 degrees to create different swells into the body of water.

6. The wave making container as recited in claim 1, wherein the wave making container forms part of a plurality of wave making containers side by side where the wave making containers can also be oscillated up and down by a dual ended hydraulic cylinder.

* * * * *